United States Patent [19]

Harrington et al.

[11] 3,943,604

[45] Mar. 16, 1976

[54] ABRASIVE SEED DEFIBERIZATION

[75] Inventors: Cecil F. Harrington, Corinth, Miss.; James M. Johnson; Howard T. Prince, both of Memphis, Tenn.

[73] Assignee: The Procter and Gamble Company, Cincinnati, Ohio

[22] Filed: Oct. 21, 1974

[21] Appl. No.: 516,514

[52] U.S. Cl. ..... 19/43; 51/309 R

[51] Int. Cl.[2] ..... D01B 1/06

[58] Field of Search ..... 19/40–44; 51/DIG. 22, DIG. 26, DIG. 29, 306 R, 309, 298

[56] References Cited

UNITED STATES PATENTS

| | | | |
|---|---|---|---|
| 1,923,579 | 8/1933 | Nahm | 19/43 |
| 3,805,332 | 4/1974 | Williams et al. | 19/44 |
| 3,852,923 | 12/1974 | Hess | 51/309 |

FOREIGN PATENTS OR APPLICATIONS

| | | | |
|---|---|---|---|
| 21,372 | 1893 | United Kingdom | 19/42 |

*Primary Examiner*—Dorsey Newton

*Attorney, Agent, or Firm*—Thomas J. Slone; John V. Gorman; Richard C. Witte

[57] ABSTRACT

An improved process and equipment for seed defiberization, for example cottonseed delinting, wherein the seed is defiberized by contact with particular abrasive surfaces. In one preferred embodiment, a conventional cotton-seed delinter is equipped with an abrasive faced cylinder instead of the conventional shaft mounted ginning saws. The abrasive cylinder comprises a shaft mounted cylinder of approximate gin saw diameter which cylinder has bonded or adhered to its facial surface an open pattern of about 40 to about 80 abrasive grit particles per square inch. The abrasive grit particles, preferably tungsten carbide grit, are sized to U.S. Sieve Series numbers of about 12 to about 40. Replacement of the ginning saws with the abrasive face cylinder requires modification to the delinter gratefall rake and seed seals to adapt their shape and clearance to the comparatively flat abrasive cylinder face. The abrasive cylinder embodiment provides means for convenient adaptation of conventional gin saw delinters to achieve increased cottonseed handling capacity, less power requirement and decreased, safer labor requirement benefits.

3 Claims, 4 Drawing Figures

ABRASIVE SEED DEFIBERIZATION

BACKGROUND OF THE INVENTION

This invention relates to seed defiberizing processes and equipment intended for the purpose of treating seed with fibers adhering thereto. The invention particularly relates to the provision of effective abrasive surfaces for seed delinting and will be illustrated by use in cottonseed delinting equipment wherein defiberizing gin saws are conventionally mounted in spaced relationship on a rotating shaft. Such gin saws achieve mechanical separation of cotton-seed and cotton fibers or linters by sawing the linter bearing cottonseed in a confined space. The gin saws require frequent, even daily, removal for sharpening with attendant dangerous handling and resetting of delinter clearances.

In contrast to delinters employing gin saw sets, the use of the presently disclosed abrasive seed defiberizing or delinting surfaces provides means for achieving surprising and unexpected advantages in machine capacity, lint and seed quality, electrical power usage and operator safety. Such advantages stem, in part, from the long lived, even full delinting season, qualities of the present open pattern abrasive particle cutting edges and to their non-glazing, non-burning properties.

Specifically, the invention comprises providing seed defiberizing surfaces which move in relation to fiber bearing seeds and abrade the fibers therefrom. The seed defiberizing surfaces comprise an open pattern of about 40 to about 80 abrasive particles per square inch of abrasive particles, preferably tungsten carbide grit, which abrasive particles are sized to U.S. Sieve Series numbers of about 12 to about 40. The abrasive particles are adhered, preferably by sinter metallic bonding, to the seed defiberizing surfaces.

The advantages of the presently disclosed abrasive surfaces are all the more surprising when viewed versus the prior art using various configurations of carborundum blocks in cottonseed delinting machines. For example, U.S. Pat. No. 358,256, issued to M. Crawford on Feb. 22, 1877, discloses a delinting maching having a vertically disposed, carborundum block faced conical stator with a conical wire brush surfaced rotor mounted concentrically therein. The cottonseed to be delinted was introduced at the top of the machine and proceeded downwardly in the annular passage formed by the conical stator and rotor while being acted upon by the carborundum surfaces and rotating brush. Other delinting machines using solid abrasive blocks mounted in various ways on vertical and horizontal shafts in delinting machines, with configurations designed to spread or regulate the passage of lint and seed through the machine are disclosed in such patents as U.S. Pat. No. 555,310 issued to J. J. Falkner on Feb. 25, 1896; U.S. Pat. No. 597,123, issued to John S. Rosamond on Jan. 11, 1898; U.S. Pat. No. 597,125, issued to F. E. Rosamond on Jan. 11, 1898; U.S. Pat. NO. 614,435, issued to T. C. Black on Nov. 22, 1898; and U.S. Pat. No. 659,840, issued to W. C. Baxter on Oct. 16, 1900. Further patents wherein abrasive materials were used are U.S. Pat. No. 753,373, issued to R. Derdeyn on Mar. 1, 1904; U.S. Pat. No. 782,223, issued to R. Derdeyn on Feb. 14, 1905; U.S. Pat. No. 821,255, issued to W. A. Ragsdale on May 22, 1906; U.S. Pat. No. 936,282, issued to W. E. Worth on Oct. 5, 1909; U.S. Pat. No. 958,456, issued to W. E. Worth on May 17, 1910 and U.S. Pat. No. 973,159, issued to G. L. Blanchard on Oct. 18, 1910. Additional patents disclosing delinting machines are U.S. Pat. No. 1,019,955, issued to C. H. Golloher on Mar. 12, 1912; U.S. Pat. No. 1,032,938, issued to W. A. Pollock on July 16, 1912; and U.S. Pat. No. 2,724,148, issued to C. W. McMath on Nov. 22, 1955.

Despite the early use of shaped carborundum blocks in delinting machines, the use of such abrasive block materials in delinters was not continued, and carborundum block delinting was supplanted early in seed defiberizing practice by the use of gin saws. Applicants believe that this retirement from use of abrasive block material was due to such factors as the difficulty of shaping, fitting, balancing and retaining such frangible carborundum block materials in the rotational parts of a delinter. Apparently, there was also the further detrimental factor that the surfaces of such abrasive blocks tended to glaze over and burn the seen and fibers. It is also probable that such abrasive block materials had a considerable heat retention capacity so that they warmed to detrimental temperatures in extended delinting use.

As will be more fully set forth hereinbelow, the present improvement in delinting stems from the application of relatively open patterns of particular grit sizes of tungsten carbide and abrasive materials of similar hardness and cutting quality to seed defiberizing or delinting surfaces. The abrasive grit is preferably adhered to the delinting surfaces by means of sintered metallic or ceramet bonding. The abrasive grit can also be adhered by other means, for example epoxy adhesives, that will both provide the necessary mechanical bond and be sufficiently worn away in use to expose the cutting edges of the abrasive particles.

SUMMARY OF THE INVENTION

In accordance with the present invention, it has been found that providing particular abrasive seed defiberizing surfaces engenders surprising benefits in the defiberizing of fiber bearing seed. For example, the use in conventional cottonseed delinters of a shaft mounted cylinder with a shell of steel or other suitable metal for sintering or adhering thereon abrasive grit particles, which cylinder has similar dimensions in face length and diameter to the gin saw set which it replaces, provides means for engendering significant capacity, quality and safety improvements in the delinting operation. As stated above, an important feature of the invention is to provide suitable grit particle sizes and surface spacings for use in delinting the seed to be handled. In cottonseed delinting operations, grit particles sized in U.S. Sieve Series numbers of about 12 to about 40, preferably about 20 to about 24, have been found desirable in spacings of about 40 to about 80, preferably about 60, grit particles per square inch. Similar seed and grit particle size relationships are effective in defiberizing other than cottonseed. As will be more fully discussed below, replacement of a gin saw set in a conventional delinter with the present abrasive cylinder is, preferably, and in most cases necessarily accompanied by redesigning and respecing the various seed and lint directing rakes and seals associated with gin saws. In general, the redesign amounts to replacing conventional gratefall rakes and seal strips designed to cooperate with and enter between spaced gin saws with plain or straight rakes and seal strips adapted to be mounted in spaced seed and lint handling relationship with the relatively flat and true face of the abrasive cylinder.

The plain strips are preferably fabricated of non-sparking material, such as aluminum, bronze or plexiglas to allow closer tolerance setting. In delinting operation, tungsten carbide grit particles have been found preferable, although abrasive grit particles of similar hardness, toughness and cutting edges production and mixtures thereof, such as silicon carbide, aluminum oxide and carborundum can be used in the practice of the present invention.

Use of the abrasive cylinder in place of conventional gin saw sets, as illustrative of the presently disclosed seed defiberizing surface efficacy, results in increased machine capacity at lower energy requirements togehter with increased quality in the seed and lint produced. Applicants have achieved capacity measures of 10% together with electric power reductions of 20% in abrasive cylinder delinter operation with the seed defiberizing surfaces presently disclosed. Avoidance of gin saw sharpening operations is also important in reducing the hazards of delinting operations to gin operators in that no daily gin saw set removal, sharpening and replacement operations are necessary together with the attendant requirements of resetting the delinter seed seal and rake clearances.

In some instances, tungsten carbide grit particles containing about 7% to 8% of cobalt have been found to provide the best sintering adherence to the delinting surfaces. The relatively open spacing of the abrasive grit particles within the disclosed limits is also considered important to the achievement of the advantages of the present abrasive cylinder. Closer spacing invites glazing over of the cutting surfaces and burning of the seed and lint while more open spacing does not provide sufficient delinting cutting points and edges. Applicants consider that sintering the abrasive grit particles on a delinting surface, for example a metallic cylinder, is preferable. Grit particles, for example tungsten carbide grit, can be sintered with and partially, about 70%, embedded in a matrix of copper, nickel or chrome. The ivention advantages can, however, be realized with other materials such as, for example, spider mounted wood cylinders and fiberglass cylinders employed together with adhesive, for example epoxy adhesive, adhered abrasive grit particles. Although the abrasive cutting surfaces of such adhesive mounted abrasive grit particles will be effectively the same as those of the preferred sintered embodiment, applicants point out that service life will tend to be decreased due to operating contact of softer more wearable materials with the seed and fibers.

While the present openly spaced abrasive concept can be applied to any seed defiberizing equipment wherein fiber bearing seeds are confined in contact with a seed defiberizing surface, it is, in one particularly preferable embodiment, applied to conventional cottonseed delinters wherein sets of gin saws are mounted in spaced relationship along a shaft. The conventional gin saw sets are replaced by a steel cylinder, a substantial wall thickness and nonvibrating construction, having the presently disclosed abrasive grit particle surface. The cylinder is most conveniently of approximately the same diameter and face length as is the effective diameter and face length of the pin saw set which it replaces.

As earlier stated herein, the use of the present abrasive cylinder in seed defiberizing operations has several important economic, quality and safety advantages. Applicants believe that these advantages all stem in part from the sharper cutting surfaces afford by tungsten carbide and like abrasive grit particles in open spaced relationship on the defibering cylinder face. Such sharper cutting surfaces in company with the ability to set very fine seal clearances against the dimension retaining abrasive cylinder face, as contrasted with the difficulty of maintaining clearances in a gin saw set wherein the effective diameter is diminshing with each daily sharpening operation, is effective in both completeness of seed delinting and avoidance of "hull pepper" generation. In any event, both delinting quality and a considerable reduction in electrical energy required to delint a given amount of seed is experienced in practice. Also, the avoiding daily handling of a conventional gin saw set with its sharp teeth engenders increased safety to the delinter operations. All of the above stated efficiency, quality and safety factors combine to engender applicants' enthusiasm for the present abrasive cylinder as an improvement in conventional delinting machines and the seed defiberizing.

It is, accordingly, a principal object of this invention to provide effective abrasive seen defibering surfaces.

It also is an object of this invention to provide effective seen defiberizing surfaces which comprise abrasive particles of selected grit size mounted in relatively open patterns.

It is a further object of this invention to provide an abrasive surfaced cylinder with a relatively open pattern of selected grit size abrasive particles and having a similar diameter and face length to the effective cylindrical measurements of the gin saw set which it replaces in a conventional cottonseed delinter.

BRIEF DESCRIPTION OF THE DRAWINGS

Other objects and advantages of this invention will become apparent as the description thereof proceeds in accordance with, and as illustrated by, the accompanying drawings. In the drawings like numbers refer to like components and a preferred embodiment of the present abrasive seed defiberizing surfaces, adapted to a conventional cottonseed delinter, is illustrated.

DESCRIPTION OF THE PREFERRED EMBODIMENTS

Figure 1:
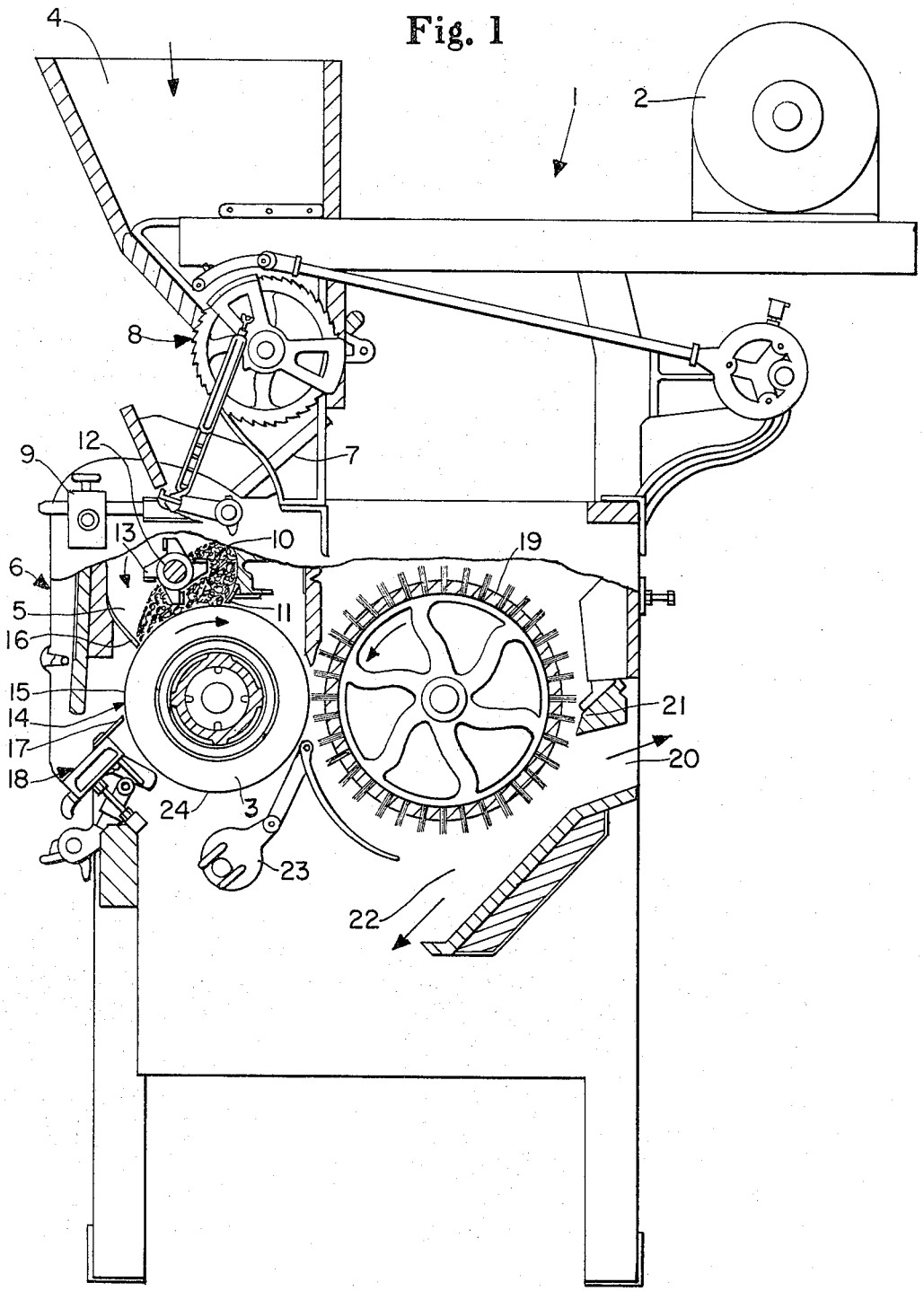
FIG. 1 is a side view of a widely used conventional cottonseed delinting machine with the present abrasive seed defibering cylinder mounted therein to illustrate the various components of such delinting machines in operational juxtaposition together with modifications in such machine to accommodate the present abrasive delinting cylinder.

Referring now to FIG. 1 of the drawings, there is illustrated, as an illustrative example of seed defiberizing equipment, a widely used and conventional cottonseed delinting machine 1 known as the "Carver" delinting machine. The Carver delinting machine is produced and sold by the Murray Carver Division of North American Rockwell, Dallas, Texas. Cottonseed delinting machine 1 is driven by belt and pulley drives, not a part of the present invention, from electric motor 2. In FIG. 1, the conventional gin saw set presently used in the industry or a seed defiberizing means is replaced as a seed defiberizing surface by abrasive seed defiberizing cylinder 3. Incoming raw cottonseed with lint thereon, entering the cottonseed delinting machine 1 at seed hopper 4, is directed to seed roll bin 5 over magnet board 7 for the removal of tramp iron and steel. The incoming fiber bearing seed, for example, raw cottonseed, is regulated in supply by ratchet and pawl seed feeding mechanism 8, as influenced by seed roll density regulator weight 9, to operate as a seed supply regulating means in forming seed roll 10. In seed roll bin 5, defined in part by breast 6 and acting as a means for confining seed in contact with a seed defiberizing means, the seed roll 10 is retained by seed roll seal strip 11 and agitated by the float vanes 13 of float 12 to maintain the seed roll 10 in a state of even agitation against the abrasive seed delinting cylinder face 14. In this seed roll 10, the abrasive grit particles 15, preferably tungsten carbide grit particles, adhered on abrasive seed delinting cylinder face 14 act upon the seed surfaces in a confined space to cut cotton linter fibers therefrom so that the defiberized or delinted seed is able to pass between seed seal strip 16 and abrasive seed delinting cylinder face 14. Seed seal strip 16 is a straight bar, preferably of aluminum or bronze as are all such strips in spaced relationship with abrasive seed delinting cylinder face 14. Seed seal strip 16 is positioned in spaced relation to abrasive seed delinting cylinder face 14 to allow delinted seed clearance and passage. Abrasive seed defiberizing cylinder 3, for example a spider mounted cylinder of 11 gauge steel, rotates in a clockwise direction such that seed is retained in seed roll 10 until delinted and then falls between abrasive seed delinting cylinder face 14 and seed seal strip 16. The delinted seed is deflected by gratefall seed seal strip 17 mounted on grate fall 18 and falls to a seed conveyor, not shown, for removal and storage.

The cotton linters cut from the seed is held on abrasive seed delinting cylinder face 14 and passes below seed roll seal strip 11 and around to brush 19. Brush 19 revolves against abrasive seed delinting cylinder face 14 at a differential speed to remove or doff the cotton linter fibers which exit through lint discharge 20 after being doffed from brush 19 by tail board 21. In other delinter configurations brush 19 can be dispensed with, and separated cotton linter or cotton staple removal can be effected by air movement along.

Motes, consisting in part of heavier stalk, twig and cotton boll particles, are discharged thru motes discharge 22 as influenced by air flow adjusted by draft adjustment 23.

Figure 2:
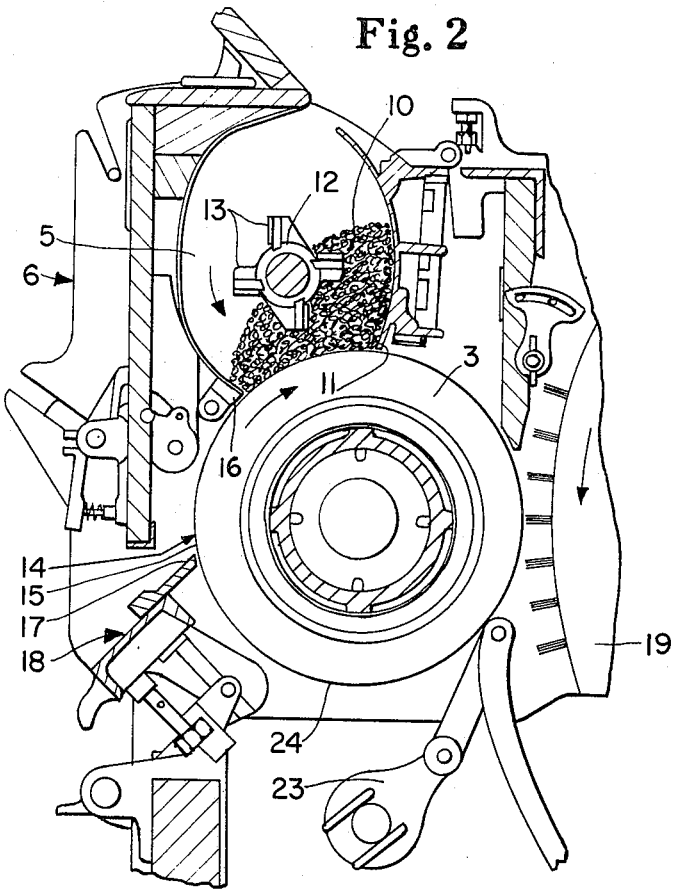
FIG. 2 is a partial enlarged side view of the delinting machine illustrated in FIG. 1, which partial enlarged view further illustrates the operational placement of the present abrasive delinting cylinder together with modifications in the delinting machine required to realize its full advantages.

FIG. 2 illustrates an enlarged portion of FIG. 1 around abrasive seed defiberizing cylinder 3 for greater clarity in showing the positioning of seed seal strip 16, seed roll seal strip 11 gratefall seed seal strip 17 and the contact of brush 19 to remove lint from abrasive seed delinting cylinder face 14. As stated above, certain surprising economies, including increased capacity, improved delinting, avoidance of lint or seed burning and operator safety have been achieved with the present abrasive seed defiberizing cylinder 3 whose abrasive form is further illustrated in FIG. 3 illustrating an enlarged portion of abrasive seed delinting cylinder face 14.

Figure 3:
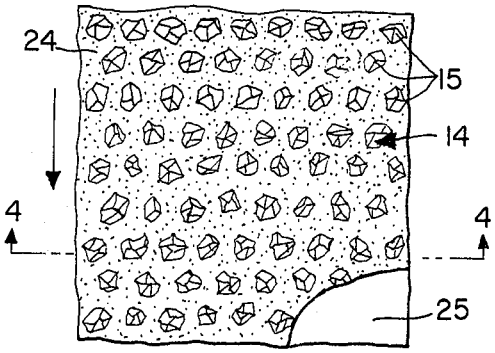
FIG. 3 is an enlarged plan view of a section of the abrasive seed defiberizing surface of the present invention, which view shows the placement of the abrasive grit particles in adhesively mounted relationship in the abrasive surface.

FIG. 3 shows abrasive grit particles 15 on an enlarged portion of abrasive seed delinting cylinder face 14 as adhered to abrasive cylinder shell 25. The defiberizing nature and configuration of abrasive seed delinting cylinder face 14 and abrasive grit particles 15 adhered thereon on abrasive seed defibering cylinder 3 is essential in practice of the present invention.

Applicants have found that effective seed defiberizing can be achieved with abrasive grit particles 15 sized to U.S. Sieve Series numbers of about 12 to about 40. It is preferred, however, in the delinting of cotton seed that abrasive grit particles 15 be sized to U.S. Sieve Series numbers of about 20 to about 24 for maximum lint removing efficiency. Although the abrasive particle density on abrasive seed delinting cylinder face 14 can be widely varied while avoiding cylinder diameter or out-of-round variations caused by piling up abrasive grit particles 15, applicants have found that the preferred densities are about 40 to about 80 abrasive grit particles 15 per square inch. This abrasive grit particles 15 spacing is, in part, governed by the desirability of having a full effective surface of abrasive points while maintaining an open non-glazing pattern. Such density and configuration of abrasive grit particles 15 achieves defiberizing efficiency by enabling close clearance setting in seed roll seal strip 11, seed seal strip 16 and gratefall seed seal strip 17. In using abrasive seed defiberizing cylinder 3 in delinting machines, applicants have discovered that a peripheral speed for abrasive seed defiberizing cylinder 3 of about 28,000 feet per minute is most satisfactory with abrasive seed defiberizing cylinder 3 having a diameter of 12 inches. This peripheral speed, i.e. speed of the abrasive seed defiberizing surface relative to the fiber bearing seed, can be varied quite widely, between about 20,000 feet per minute and 35,000 feet per minute and would vary with seeds other than cottonseed.

As stated above, applicants' prefer a spacing of about 40 to 80 abrasive grit particles 15 per square inch because particle spacings of lesser dimension, i.e. more particles per square inch tend to result in piling up abrasive grit particles 15 during application thereof on the abrasive cylinder shell 25 together with the sinterable metal bonding material. Any such piling up of abrasive grit particles 15 in sintered metal matrix 24 contributes undesirable out-of-roundness to abrasive seed defiberizing cylinder 3 and makes it difficult to set the close seal tolerances involved in accepting or rejecting delinted seed and linters.

Figure 4:
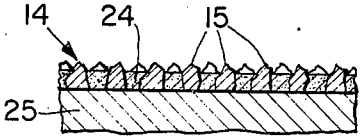
FIG. 4 is an enlarged cross-section of the abrasive seed defiberizing surface illustrated in FIG. 3 taken along the line 4—4 to illustrate the adhesive mounting of the abrasive particles on the abrasive seed defiberizing surface.

FIG. 4 illustrates an enlarged cross-section of a portion of abrasive seed delinting cylinder face 14 taken thru line 4—4 of FIG. 3 and illustrating the adherence of abrasive grit particles 15 to abrasive cylinder shell 25 by sintered metal matrix 24. The nature of sintered metal matrix 24 with regard to holding abrasive grit particles 15 in place on abrasive seed delinting cylinder face 14, as partial embedment with exposed cutting points and edges, is seen in FIG. 4. Applicants have used a variety of sinterable metal materials to effect bonding of the abrasive grit particles 15 with abrasive cylinder shell 25. Effective sinterable bonding materials include metals such as copper, nickel, and chrome. Boron containing ceramet material has also been found as a sintered metal matrix to adhere abrasive grit particles 15 to a seed contacting surface. Of these materials, a nickel matrix having a Rockwell C hardness of about 58 is considered ideal for the combination purposes of wearing sufficiently to successively expose the cutting edges and points of abrasive grit particles 15 and to resist erosion and wear in seed defiberizing use.

Such sintered metal matrices containing abrasive grit particles 15, preferably tungsten carbide grit, can be supplied and applied to seed defiberizing surfaces, including abrasive seed delinting cylinder face 14 by suppliers dealing in wear resistant metallic and metal abrasive coatings such as Permanence Corporation of Detroit, Michigan; Functional Products Company (Division of Burgess-Norton Manufacturing Company), Geneva, Illinois and Boride Wear Coatings, Inc. (Subsidiary of Piper Industries), Collierville, Tennessee.

Placement of the abrasive grit particles 15 can, preferably, be accomplished by spraying abrasive cylinder shell or other seed defibering surface with a slurry containing abrasive grit particles 15, flux and sinterable metal powders. After spraying the deposited materials are subjected to sintering temperatures. Sinterable metal paste placement and wear coat welding techniques can also be employed to effect a suitable adherence of abrasive grit particles 15. After sintering abrasive grit particles 15 on abrasive seed delinting cylinder face 14, abrasive seed defiberizing cylinder 3 can be improved in concentricity by passage thru a ring die after heating to annealing temperatures.

It is to be understood that the described usage of an abrasive seed defiberizing surface, as adapted to use in a conventional cottonseed delinting machine, is only exemplary and is not limiting with regard to the use of such abrasive seed defiberizing surfaces in other equipment as will be obvious to those skilled in the art.

Having thus described the invention, what is claimed is:

1. In a seed delinter comprising a seed bin comprising a seed roll seal strip and a seed seal strip, means for regulating a supply of lint bearing seeds in said bin, a defiberizing cylinder having a delinting face on a radially outwardly facing cylindrical surface, means for agitating said supply and for confining seeds in contact with said delinting face, and means for rotating said cylinder so that said delinting face moves sufficiently fast relative to said seeds to substantially delint said seeds, the improvement wherein:

said delinting face comprises an open pattern of unpiled abrasive particles which particles are adhered in spaced relation to said radially outwardly facing cylindrical surface of said defiberizing cylinder, said open pattern comprising from about forty to about eighty said abrasive particles per square inch to the seed contacting surface, which abrasive grit particles are in the size range of U.S. Sieve Series numbers of from about twelve to about forty;

said seed roll seal strip is disposed in non-contacting relation with said delinting face and is spaced sufficiently close to said delinting face to substantially obviate seeds passing therebetween; and said seed seal strip is spaced sufficiently close to said delinting face to substantially obviate the passage of lint bearing seeds therebetween yet is spaced sufficiently far from said face to freely pass substantially delinted seeds therebetween.

2. The seed delinter of claim 1 wherein said delinting face comprises an unpiled, open pattern of about sixty abrasive particles of tungsten carbide per square inch, which abrasive particles are sized to U.S. Sieve Series numbers from about twenty to about twenty-four and are adhered to said cylindrical surface by and partially inbedded in a sintered metal matrix.

3. The seed delinter of claim 2 wherein said sintered metal matrix comprises nickel having a Rockwell C hardness of about 58 whereby said matrix will resist erosion yet wear sufficiently fast with respect to the rate of wear of said abrasive particles to assure continuous partial exposure of said abrasive particles.

* * * * *

UNITED STATES PATENT OFFICE
CERTIFICATE OF CORRECTION

PATENT NO. : 3,943,604

DATED : March 16, 1976

INVENTOR(S) : Cecil F. Harrington, James M. Johnson, Howard T. Prince

It is certified that error appears in the above-identified patent and that said Letters Patent are hereby corrected as shown below:

Column 2, line 18, "seen" should be...seed...

Column 3, line 6, "edges" should be...edge...

Column 3, line 40, "ivention" should be...invention...

Column 3, line 63, "pin" should be...gin...

Column 4, line 23, "seen" should be...seed...

Column 4, line 25, "seen" should be...seed...

Column 4, line 67, after "of the abrasive" insert...grit...

Column 8, lines 17 and 18, delete...to the seed contacting surface, which abrasive grit particles are...

Column 7, line 16, "metal" should be...metallic...

Signed and Sealed this

Twentieth Day of July 1976

[SEAL]

*Attest:*

RUTH C. MASON
*Attesting Officer*

C. MARSHALL DANN
*Commissioner of Patents and Trademarks*